US006050450A

United States Patent [19]

Gardos

[11] Patent Number: 6,050,450

[45] Date of Patent: Apr. 18, 2000

[54] APPARATUS AND SYSTEM FOR PRECISION DISPENSING OF FLUIDS AND METHOD OF OPERATING THE SAME

[75] Inventor: Ivan Gardos, Schrewsbury, Mass.

[73] Assignee: Dispensing Technologies International Incorporated, Clinton, Mass.

[21] Appl. No.: 09/221,495

[22] Filed: Dec. 28, 1998

[51] Int. Cl.[7] ..... B67B 7/00

[52] U.S. Cl. ..... 222/1; 222/63; 222/333; 222/390; 222/644; 604/255; 604/224

[58] Field of Search ..... 222/1, 41, 63, 222/333, 390, 644; 422/100; 604/155, 224

[56] References Cited

U.S. PATENT DOCUMENTS

| | | | |
|---|---|---|---|
| 3,242,881 | 3/1966 | Schafer | 222/333 |
| 3,336,925 | 8/1967 | Thompson, III | 222/333 |
| 3,390,815 | 7/1968 | Kavan et al. | 222/333 |
| 3,415,419 | 12/1968 | Jewett et al. | 222/333 |
| 3,771,694 | 11/1973 | Kaminski | 222/70 |
| 3,997,084 | 12/1976 | Davis, Jr. | 222/333 |
| 4,335,834 | 6/1982 | Zepkin | 222/63 |
| 4,424,720 | 1/1984 | Bucchianeri | 222/390 |
| 4,731,058 | 3/1988 | Doan | 604/155 |
| 4,769,009 | 9/1988 | Dykstra | 604/155 |
| 4,799,866 | 1/1989 | Faeser et al. | 222/333 |
| 4,891,185 | 1/1990 | Goldin | 222/644 |
| 5,047,012 | 9/1991 | Leuschner et al. | 604/224 |
| 5,050,773 | 9/1991 | Choi | 222/63 |
| 5,553,740 | 9/1996 | King et al. | 222/1 |
| 5,630,527 | 5/1997 | Beebe et al. | 222/1 |
| 5,656,034 | 8/1997 | Kochersperger et al. | 604/155 |
| 5,765,722 | 6/1998 | Beebe et al. | 222/1 |
| 5,839,612 | 11/1998 | Burke | 222/333 |

FOREIGN PATENT DOCUMENTS

| | | | |
|---|---|---|---|
| 61-262618 | 11/1986 | Japan | 222/63 |

*Primary Examiner*—Andres Kashnikow
*Assistant Examiner*—Jorge Bocanegra

[57] ABSTRACT

A fluid dispenser wherein a fixed threaded shaft carries a moveable microprocessor-controlled electric drive motor integrally provided with a shaft extension carrying a plunger for directly contacting and compressing fluid in a syringe barrel to dispense the fluid in accordance with programmed shot volume increments (as small as 0.001 cc, for example) set in the microprocessor, and provided further with provision for the automatic refilling of the syringe barrel upon completion of the fluid dispensing by the plunger

14 Claims, 3 Drawing Sheets

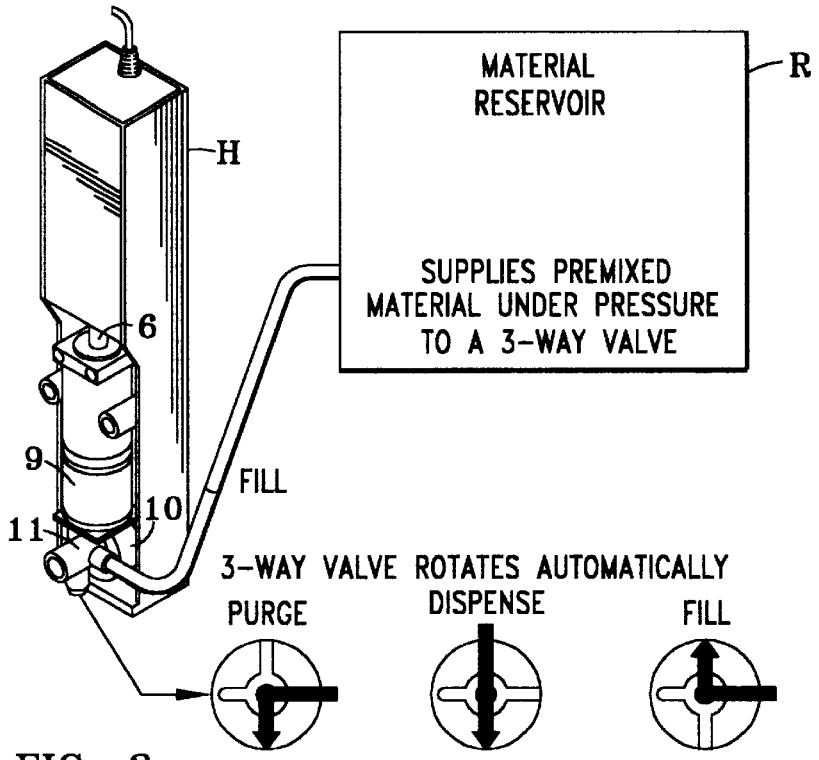
FIG. 3
FIG. 4
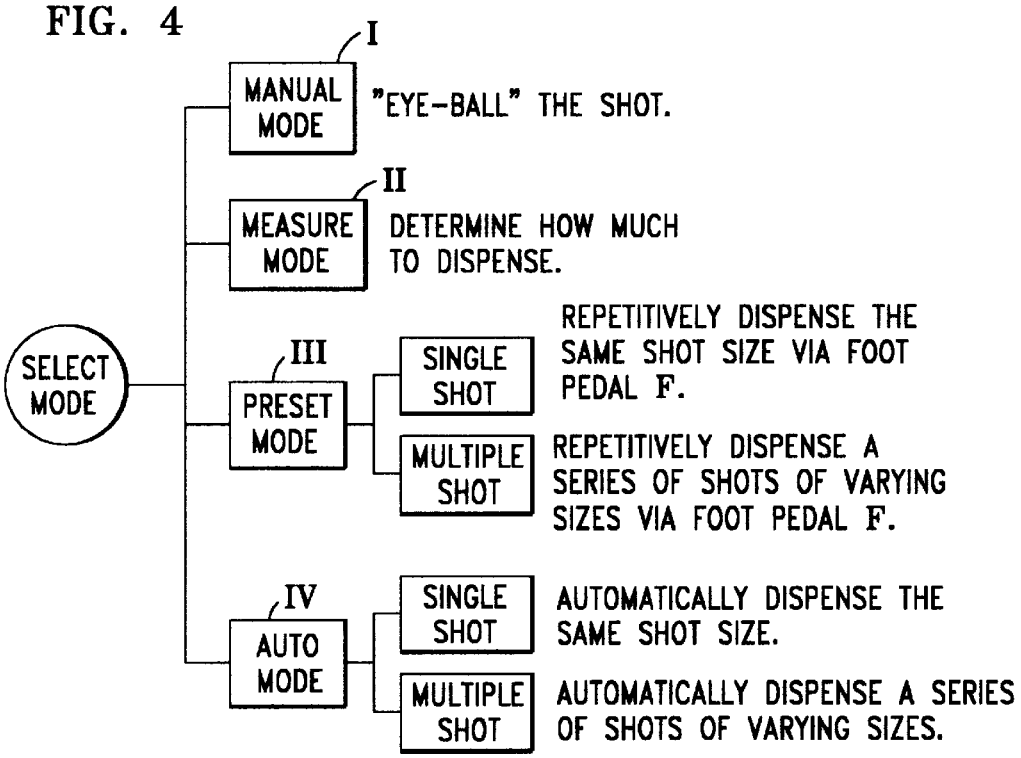

APPARATUS AND SYSTEM FOR PRECISION DISPENSING OF FLUIDS AND METHOD OF OPERATING THE SAME

The present invention relates to the dispensing of low-to-high viscosity fluids and the like, being more particularly directed to microprocessor-controlled electrically driven fluid dispensers for the precision or micro-dispensing of controlled volume or size quantities, for example, down to the order of 0.001 cc droplets, as from needle-like nozzles supplied from fluid syringes and the like.

BACKGROUND

In has been previously proposed to use microprocessor-controlled electric-motor-driven fluid dispensers in which conventional syringe and piston assemblies (such as used in medical and related applications) are acted upon, under microprocessor control, to push the piston controlled distances into the fluid-filled syringe in order to dispense predetermined volume or size fluid droplets from the syringe, as through a terminal needle or the like. U.S. Pat. Nos. 5,630,527 and 5,765,722 (and patents referred to therein) are examples of such dispensers, as are the dispensing syringe pump systems of Cole-Parmer Instrument Company described in their 1993-4 Instruments Catalog, pages 1025-6. For purposes of uniformly depressing the piston of such conventional—syringe-and-piston assemblies, a movable or displaceable driving rod (such as a threaded rod) is moved through a central aperture in a fixed electric motor that drives the rod, to insert a plunger disposed at the end of the rod into the syringe and into flat engagement with the piston of the syringe and piston assembly, thereby to move the piston the desired amount into the syringe. Such techniques requiring a driven flat plunger to engage and then set in motion the stationary piston of the conventional syringe-and-piston assembly, however, has been found, in practice, to be subject to lag caused by the inertia in engaging and moving the syringe piston and starting the consequent expulsion of the fluid from the syringe, and subject to less than a very sharp, controlled cut-off—with limitations, also, on the smallest size droplets dispensable and the precise micro-control of the same.

It is to the obviating of such problems and limitations that the construction and operation of the present are directed, enabling a great improvement in the instantaneous dispensing and in the sharp, controlled cut-off, and with previously unattainable uniform micro-size droplets.

OBJECTS OF INVENTION

A principal object of the invention, accordingly, is to provide a new and improved microprocessor-controlled fluid dispensing apparatus and method that overcome the above-described and other limitations of prior art syringe dispensers and the like, and that, to the contrary, provide instantaneous start and sharp, micro cut-off of uniformly controlled fluid droplets, and achieving much smaller volume or size than heretofore producible, and without the limitation of having to operate with conventional syringe and piston assemblies.

A further object is to provide such a novel apparatus with monitoring capability to insure the correspondence between desired microprocessor-set droplet size and actual dispensed droplet size.

Still another object is to provide in such a dispenser an automatic refilling feature of the syringe after dispensing fluid therefrom.

Other and further objects will be explained hereinafter and are more particularly delineated in the appended claims.

SUMMARY

In summary, however, from one of its important viewpoints, the invention embraces a fluid-dispensing system having, in combination, a fixed longitudinal screw shaft carrying in threaded engagement therewith, an electric motor assembly rotatably longitudinally incrementally movable therealong; the motor assembly integrally carrying a depending longitudinal tubular extension terminally provided with a plunger dimensioned to enter and slide within a fluid-containing syringe barrel to contact the fluid as the motor assembly moves along the fixed screw shaft, and a microprocessor for programming the motor energization movement rate, time intervals of movement, fluid volume increments to be dispensed and other parameters, for correspondingly controlling the fluid dispensed from the syringe barrel.

Preferred and best mode designs and operational techniques are later described in detail.

DRAWINGS

The invention will now be described in connection with the accompanying drawing, FIG. 1 of which illustrates the preferred dispenser construction and operational system of the invention in a combined block circuit diagram and isometric view, partly sectionalized to illustrate details of construction;

FIG. 3 is a side elevation of the same, illustrating details of the filling valve mechanism, and FIG. 4 a flow chart of operating steps.

PREFERRED EMBODIMENT OF INVENTION

Figure 1:
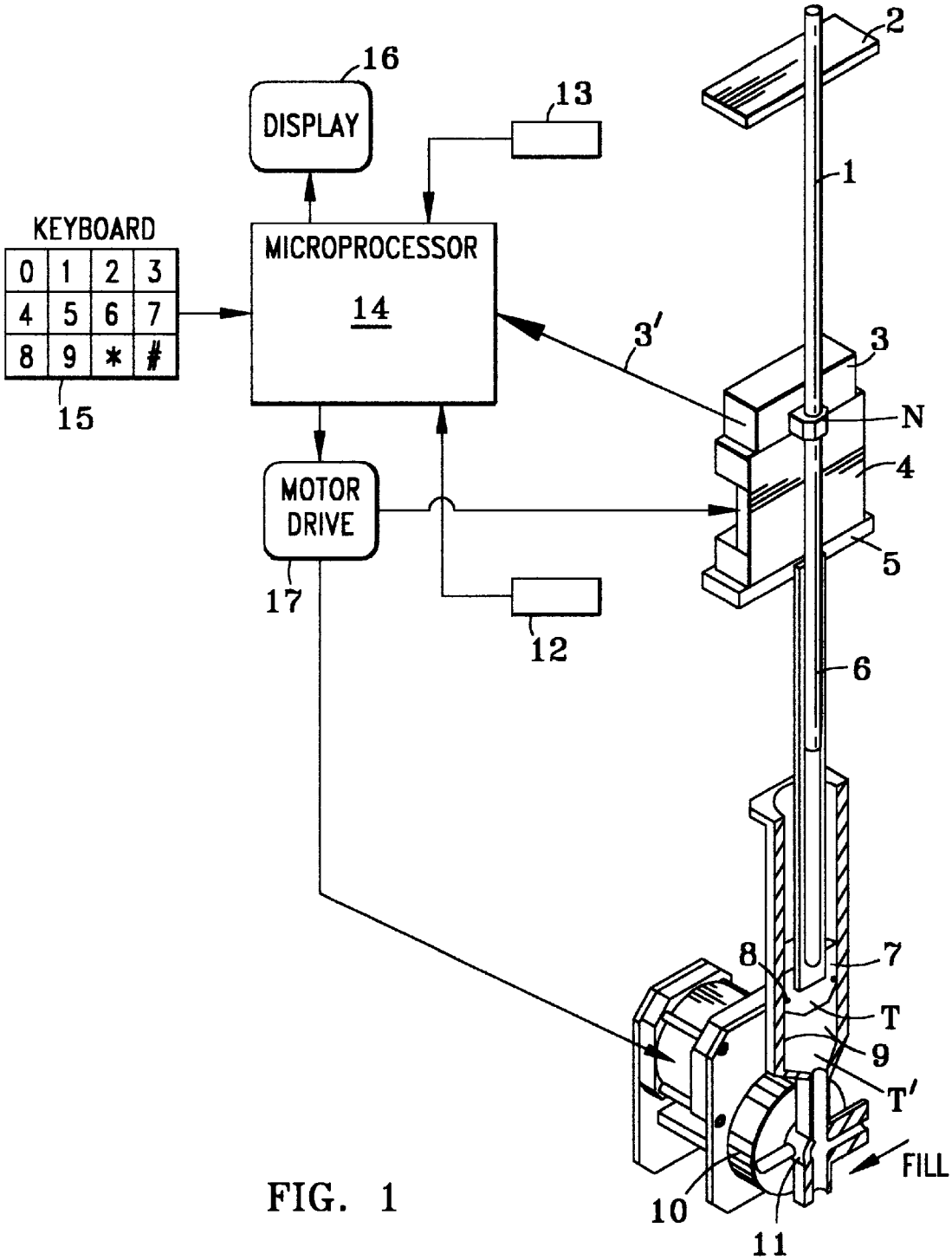

The dispenser of the invention is shown, for illustrative purposes, as vertically mounted (for example on a stand, not shown), and comprises an electric motor 4 guided in vertical movement up and down a threaded longitudinal screw shaft 1 that is permanently fixed at its upper end to a stationary top plate 2. The fixed screw shaft 1 is illustrated in FIG. 1 as passing through the center of an electric motor assembly 4, fixed on its underside to a mounting plate 5 and carrying on its upper surface an encoder 3 that sends pulses to a microprocessor 14 indicative of the distance that the motor 4 has traveled along the fixed screw shaft 1. The encoder 3, motor 4 and mounting plate 5 constitute an integral assembly that is centrally axially apertured to ride longitudinally up and down upon the fixed screw shaft 1 by virtue of a nut N fixed in the center of the motor rotor and engaging the shaft threads. The position of the motor along the longitudinal axis of the shaft is in direct proportion to the rotation of the motor, with the motor assembly being forced to travel longitudinally along the screw shaft 1.

Fixed and depending below the mounting plate 5, and longitudinally movable along the shaft integrally with the motor assembly, is a depending tubular extension surrounding a shaft extension 6 and carrying a plunger 7, preferably, tapered at T and dimensioned to enter and travel within a piston-less fluid-containing syringe barrel 9 of any desired type, directly to contact the fluid in the syringe. An 0-ring seal 8 is provided circumferentially of the plunger 7 to provide a fluid seal while the plunger enters and slides along the inner walls of the syringe barrel and directly contacts and pushes the fluid to be dispensed, with the vertex of the tapered plunger T leading, and the tapered walls of the plunger following, in the compression, substantially parallely to the conical or tapered outlet $T^1$ at the bottom or outlet of the syringe barrel 9. This type of compression action by the plunger T has been found to be one of the reasons for the instantaneous dispensing and sharp cut - off results attainable with the microprocessor control of the invention, and as distinguished from the above-described prior art wherein the stationary conventional flat syringe piston must be set in motion.

Figure 2:
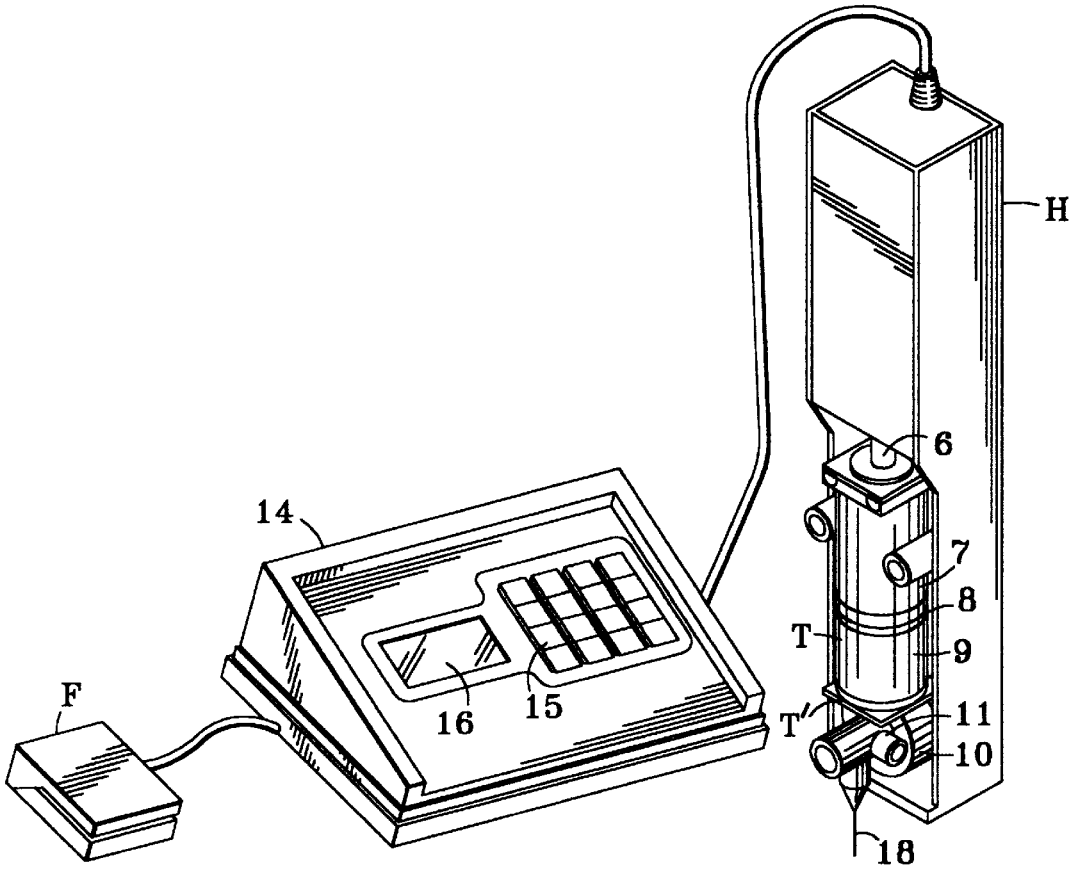
FIG. 2 is a view of an actual instrument.

In practice, the assembly is contained in a housing N, FIGS. 2 and 3, with the syringe and valve exposed. In operation, the user enters the desired dispensing parameters (motor energization rate, time interval of movement, fluid volume increments be dispensed, etc.) into the microprocessor 14 via the keypad 15, FIGS. 1 and 2, in well-known fashion. The microprocessor 14 communicates to the user via a conventional display 16, (such as an alpha-numeric LCD screen or the like, FIG. 2) and it also sends control signals to the motor driver control 17 for energizing and controlling the motor 4. As the motor 4 rotates and turns the before - described encoder 3, the number of pulses sent thereby to the microprocessor 14 along path 3' is a direct result of the distance traveled by the motor assembly rotating along the shaft 1, and thus by the plunger 7 entering into the syringe barrel 9 and the resulting volume of fluid dispensed though the outlet $T^1$ the distance traveled by the plunger, of course, controlling the amount of liquid dispensed, as from the needle or other nozzle 18, FIG. 2. That number of pulses is then monitored by comparison to the programmed volume to verify that the programmed volume was actually dispensed, and if not, so to alert the user to enable adjustment. The motor control may be operated in any conventional manner, shown in FIG. 2, as by a foot switch pedal F.

When the preferably tapered plunger T reaches the bottom position, mating with the before-described tapered preferably conical outlet bottom wall $T^1$, completing the fluid dispensing from the syringe, such is sensed by the sensor 12 (optical, for example), and fed to the microprocessor 14, A motor-driven rotator head 10 is automatically energized from the motor-driver 17 to turn a stop cock, preferably a three-way valve 11, to a fill position ("FILL"), connecting to a fluid supply reservoir R, FIG. 3. If the fluid dispensed is of low viscosity, then the vacuum created in the syringe 9 is usually sufficient to refill the syringe from the reservoir or supply source. If the fluid is of high viscosity, then the syringe can be refilled under pressure. At the lower right of FIG. 3, the three positions of operation of the three -way valve 11 are illustrated, respectively for purging, normal dispensing, and re-filling.

The plunger 7, as carried by the motor 4 and tubular extension 6, travels back, withdrawing upwardly to the top of the syringe by the reverse energization of the motor by the microprocessor, the return being sensed by the upper sensor 13.

The mode of operation may be selected by entry at the keyboard 15, FIGS. 1 and 2, and may assume manual (I), dispensing measurement (II), preset single or multiple shot dispensing (III), or automatic single or multiple shot (IV) modes, as shown in FIG. 4. In the manual mode (I), the user "eye-balls" the dispensed shot for approximate shot volume. Actual determinations of how much to dispense may be determined in the measure mode II. The presetting in the microprocessor (mode III) will enable repetitive dispensing of the same single shot size through user actuation of the foot pedal or other switch F, FIG. 2, or repetitively to dispense a series of shots, and of varying sizes as desired. In the automatic mode (IV), on the other hand, automatic microprocessor-controlled dispensing of single same-size shots or series of shots of varying sizes is obtainable.

In summation, the invention, as distinguished from prior art motor- driven movable or displaceable drive rods or screws and the like having terminal flat plates for mating engaging with the flat syringe pistons to move them to dispense the fluid from the syringe barrel, maintains the drive rod or screw in fixed position, and, to the contrary, causes the drive motor to rotate and to move up or down the screw shaft. That shaft integrally carries a depending tube or cylinder fixed to the motor assembly and terminating in a preferably (though not essentially) tapered plunger that enters the syringe barrel and directly contacts the fluid without the intermediary of a syringe piston or any required flat mating engagement therewith. It has been found, indeed, in accordance with the present invention, that such direct tapered-wall compression of the fluid enables the high degree of precision and control in dispensing, with the sharp cut-off and instantaneous start of the dispensing that, it is believed, the present invention is the first, to provide to this degree in this art (increments of 0.001 cc microshots, up to the maximum volume of the syringe barrel being used—10 cc or 30 cc, for example). The automatic filling or refilling of the syringe barrel, in accordance with the invention, by the opening of the bottom three-way valve and the introduction, of fluid into the bottom of the syringe barrel, works directly against the tapered plunger without leakage.

Because the plunger directly contacts the fluid material in the syringe, furthermore, when the plunger is retracted ("suck-back"), it pulls back directly on the material, effectively preventing resultant dripping. The operator, moreover, may be able to select the amount of "suck-back" or retraction of the plunger according to an indexed scale. This retraction operation of the invention is especially important when using high viscosity materials. Since these require greater force to dispense, more pressure builds up in the syringe container. Although the plunger itself may cease to push on the material, the accumulated pressure will tend to continue forcing material out of the syringe. By retracting the plunger slightly, the pressure is relieved and thus the resultant dripping is reduced or eliminated.

These novel improvements of the invention provide for the precise micro-dispensing of low-to-high viscosity fluids under programming control from an automatically refillable syringe barrel that allows for continuous operation without the need for operator intervention to refill the syringe barrel or to swap out the syringe barrel. The invention further provides feed-back monitoring that confirms that the shot volumes dispensed equal the volumes programmed, alerting the operator to any discrepancy. The microprocessor-controlled keyboard and display, moreover, readily enable the operator to set the "shot" size, the dispensing speed, the shot sequence, and the time intervals between shots.

The technique of the invention is also useful with other fluid-filled containers than syringe assemblies, both conventional and special, and some of the novel features of the invention are also useful alone apart from in combination with the others. Nozzle dispensers, other than needle-like micro-nozzles 18, may also be connected at the syringe outlets, or other outlet devices may also be used. Further modifications will also occur to those skilled in this art, and such are considered to fall within the spirit and scope of the invention as defined in the appended claims.

What is claimed is:

1. A fluid-dispensing system having, in combination, a fixed longitudinal screw shaft carrying in threaded engagement therewith, an electric motor assembly rotatably longitudinally incrementally movable therealong, the motor assembly integrally carrying a depending longitudinal tubular extension terminally provided with a plunger dimensioned to enter and slide within a fluid-containing syringe barrel into direct contact with the fluid therein as the motor assembly is moved along the fixed screw shaft; and a microprocessor for programming the motor energization movement rate, time intervals of movement, fluid volume increments to be dispensed and other parameters, for correspondingly controlling the fluid dispensed from the syringe barrel.

2. The dispensing system of claim 1 wherein a sensor monitors the completion of the dispensing by the plunger and so signals the microprocessor for reversely energizing the motor to withdraw the plunger to the top of the syringe barrel.

3. The dispensing system of claim 2 wherein, upon said completion of the dispensing, the microprocessor automatically, in response to the signal from said sensor, actuates a fluid-filling valve at the bottom of the syringe barrel to enable refilling the syringe barrel.

4. The fluid-dispensing system as claimed in claim 1 wherein the plunger is tapered.

5. The fluid-dispensing system as claimed in claim 4 wherein the bottom of the syringe barrel from which the fluid is dispensed is provided with conically tapered walls similar to the plunger taper.

6. The fluid-dispensing system as claimed in claim 1 wherein the motor is mounted with an encoder for providing pulses to the microprocessor as the motor turns, the number of pulses being a measure of the distance traveled by the motor along the screw thread and thus also of the distance traveled by the plunger within the syringe barrel and the resulting volume of fluid dispensed from the syringe barrel.

7. The fluid-dispensing system as claimed in claim 6 wherein a display is provided for enabling comparison of the programmed fluid volume to-be-dispensed with the actual fluid volume dispensed from the syringe barrel.

8. A method of fluid dispensing under the control of a longitudinal screw shaft carrying an electric motor integrally provided with a depending longitudinal extension terminating in a plunger, the method comprising, fixing the screw shaft against movement; energizing the motor under programmed microprocessor control to cause the motor rotatingly to move longitudinally along the screw shaft in programmed increments; positioning a longitudinal fluid-filled syringe barrel below the plunger to receive the same within the barrel for directly compressing the fluid to dispense the same from the syringe barrel in accordance with said programmed increments to dispense corresponding programmed fluid volumes from the syringe barrel.

9. The method claimed in claim 8 wherein the reaching of completion of the fluid dispensing by the plunger is sensed and signaled to the microprocessor for reversely energizing the motor to cause the plunger to be withdrawn to the top of the syringe barrel.

10. The method claimed in claim 9 wherein the microprocessor, in response to the sensing of the completion of fluid dispensing by the plunger, automatically energizes the opening of a fluid-filling valve for re-filling the syringe barrel.

11. The method claimed in claim 10 wherein the dispensing is controlled in one or more of manual and automatic modes.

12. The method claimed in claim 11 wherein the dispensing is selectively controlled for repetitively dispensing the same volume shots and series of shots of varying volumes.

13. The method claimed in claim 8 wherein the direct contacting of the fluid by the plunger causes substantially instantaneous dispensing upon plunger compression, and the pulling back of the fluid upon plunger retraction.

14. The method claimed in claim 13 wherein upon ending the compressing of the fluid by the plunger, the plunger is slightly retracted to relieve pressure and eliminate fluid dripping form the syringe barrel.

* * * * *